United States Patent [19]

Kaminski

[11] 4,096,967

[45] Jun. 27, 1978

[54] ECOLOGICAL EASY-OPEN CAN END

[75] Inventor: Elton George Kaminski, Sidney, Ohio

[73] Assignee: The Stolle Corporation, Sidney, Ohio

[21] Appl. No.: 803,514

[22] Filed: Jun. 6, 1977

[51] Int. Cl.[2] ..... B65D 41/32

[52] U.S. Cl. ..... 220/269; 220/273

[58] Field of Search ..... 220/269-273

[56] References Cited

U.S. PATENT DOCUMENTS

| | | | |
|---|---|---|---|
| 3,898,227 | 8/1975 | Khoury | 220/269 |
| 3,923,193 | 12/1975 | Wells et al. | 220/269 |
| 3,929,252 | 12/1975 | LaCroce | 220/269 |
| 3,991,901 | 11/1976 | Perry | 220/269 |

*Primary Examiner*—George T. Hall

*Attorney, Agent, or Firm*—Melville, Strasser, Foster & Hoffman

[57] ABSTRACT

An ecological easy-open can end is disclosed. The pull tab cannot be removed from the can end and discarded; rather it is pushed down and snapped in under the can end where its sharp edges cannot cut the user. The pull tab has a hole in it so that when it is down inside the can it does not interfere with the dispensing of the contents of the can.

3 Claims, 15 Drawing Figures

2
2
A
A 7
7

10
11a
11b
12
13
14
14a
15
16
17
17a
20
20a
21
22
23
24a
C

ECOLOGICAL EASY-OPEN CAN END

BRIEF SUMMARY OF THE INVENTION

Easy-open cans have come into general use for beverages particularly, as well as for solid foods such as nuts. They have the great advantage that they do not require the use of a can opener in order to gain access to the contents. At the same time, such cans are coming under attack from ecologists because when the pull tab is removed from the can end it is usually tossed on the ground. This creates an unsightly condition, and also presents a danger around playfields and picnic areas where children may run around barefoot. Cuts produced by the discarded pull tabs are quite painful and are prone to become infected, necessitating a tetanus toxoid shot. Alternatively, some users will drop the separated pull tab-tear strip into the can before drinking the contents. This of course is a very dangerous procedure because the tabtear strip may be swallowed or lodged in the throat if the consumer drinks directly from the can.

Various attempts have been made in the past to overcome the above noted problems but these have not really proved successful. Some commercial versions have eliminated the tabs entirely and have simply provided scored openings in a number of different configurations. The cans in these versions are opened by the user pushing the severed opening down into the can with his thumb. In some cases an opening is actually punched out and then sealed with some material so as to be leakproof. Ends of these types have been found by consumers to be too difficult to open and also to be dangerous to the fingers of the user.

Other types of ends are being promoted which do have a tab. When this tab is lifted it pushes the scored opening into the can. The tab is then folded back to its original position prior to opening. This type is considered difficult to open and also expensive to manufacture.

Still other attempts to solve the ecology problem have involved a captive tab as in Stolle U.S. Pat. No. 3,462,042 and Kaminski U.S. Pat. No. 3,762,597. With these types of tabs, however, tab remains outside the can where it presents a sharp edge to the nose of the user drinking from the can, or to the fingers which grip the can.

One of the better solutions to the problem is disclosed in the Wells et al U.S. Pat. No. 3,923,193. Here a tab is lifted to break open the tear strip and then the tab is pushed downward and pressed against the lip of the can while a pair of lateral projections snap under the edges of the opening. This accomplishes many of the objects sought to be achieved and eliminates many of the objections of other solutions. However, it falls short of being a complete solution for several reasons. The lifting portion of the tab presents a sharp edge which would be risky for the fingers of the user. Furthermore, the lifting end projects to an extent that a plurality of loose can ends according to the Wells patent would not stack properly and the underside of one end would be scratched by the terminal end of the lifter of the end below. In high speed can closing machines feeding difficulties would be encountered and where the protective inside lacquer of the end is scratched and bare metal is exposed, the end would be unfit for direct contact with many beverages.

A number of states have now legislated against the sale and use of easy-open beverage can ends with a disposable tab-tear strip combination. Additional states are passing such legislation each year; and as a result there has been frantic activity in attempts to develop an ecologically acceptable easy-open can end.

The present invention provides a tab which is first lifted, then pushed downwardly, and then snapped entirely under the edge of the opening produced, so that the tab is captive, but disposed entirely inside the can where it cannot cut the user. The manufacturing cost is not significantly greater than that of present easy-open can ends and does not involve major changes in tooling.

BRIEF DESCRIPTION OF THE SEVERAL VIEWS OF THE DRAWING

FIG. 2 is a cross sectional view thereof taken on the line 2—2 of FIG. 1 before raising the pull tab to open the can end.

FIGS. 3 and 4 are views similar to FIG. 2 showing an intermediate and a final stage in the opening of a can end.

FIGS. 6 to 10 inclusive are views similar to FIGS. 1 to 5 inclusive showing another embodiment.

FIGS. 11 to 15 inclusive are views similar to FIGS. 1 to 5 inclusive showing still another embodiment.

DETAILED DESCRIPTION

The three embodiments shown on the three sheets of the drawings are generally similar but differ in minor details. All function in a similar manner and in all of the embodiments the pull tab is snapped entirely under the edge of the opening.

Figures 1, 2A, 2B, 4A, 4B, 5:
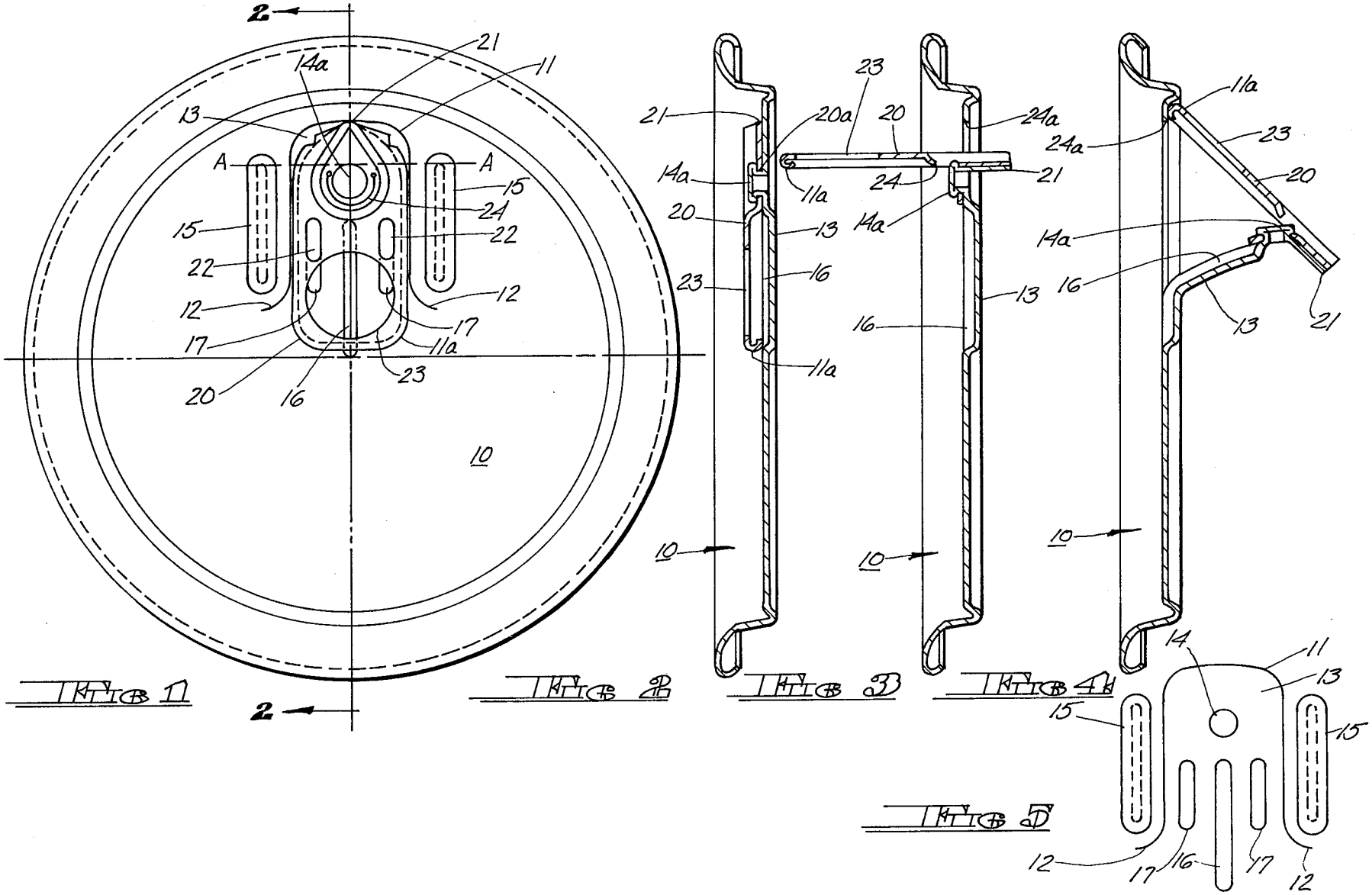
FIG. 1 is a plan view of one embodiment of the can end of this invention.
FIG. 5 is a fragmentary plan view similar to FIG. 1 before attachment of the pull tab to the can end showing the scoring, embossing and debossing.
Figures 7D, 8A, 8B, 8C, 8D:
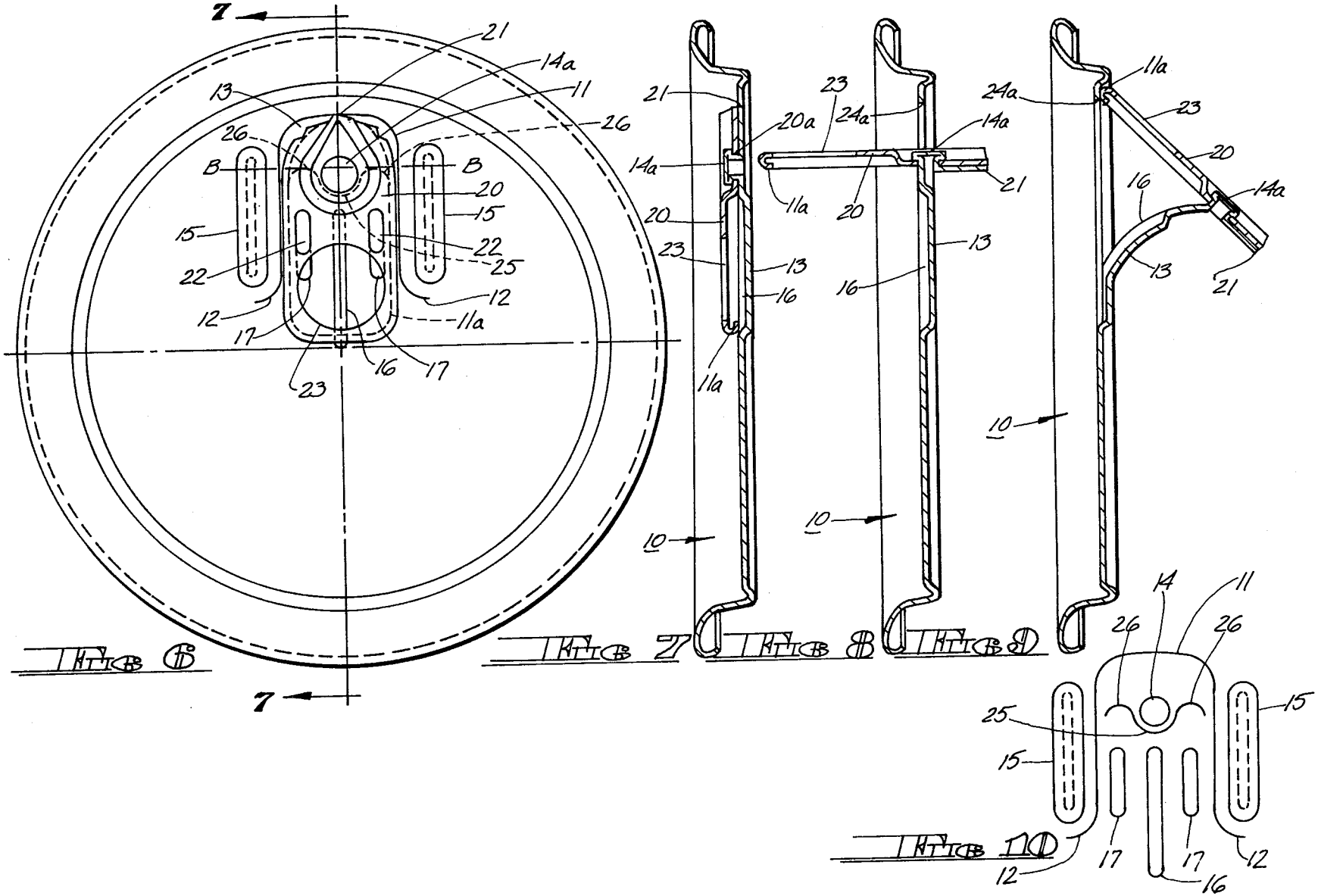
Figures 1A, 1B, 1C, 1D, 1E, 1F:
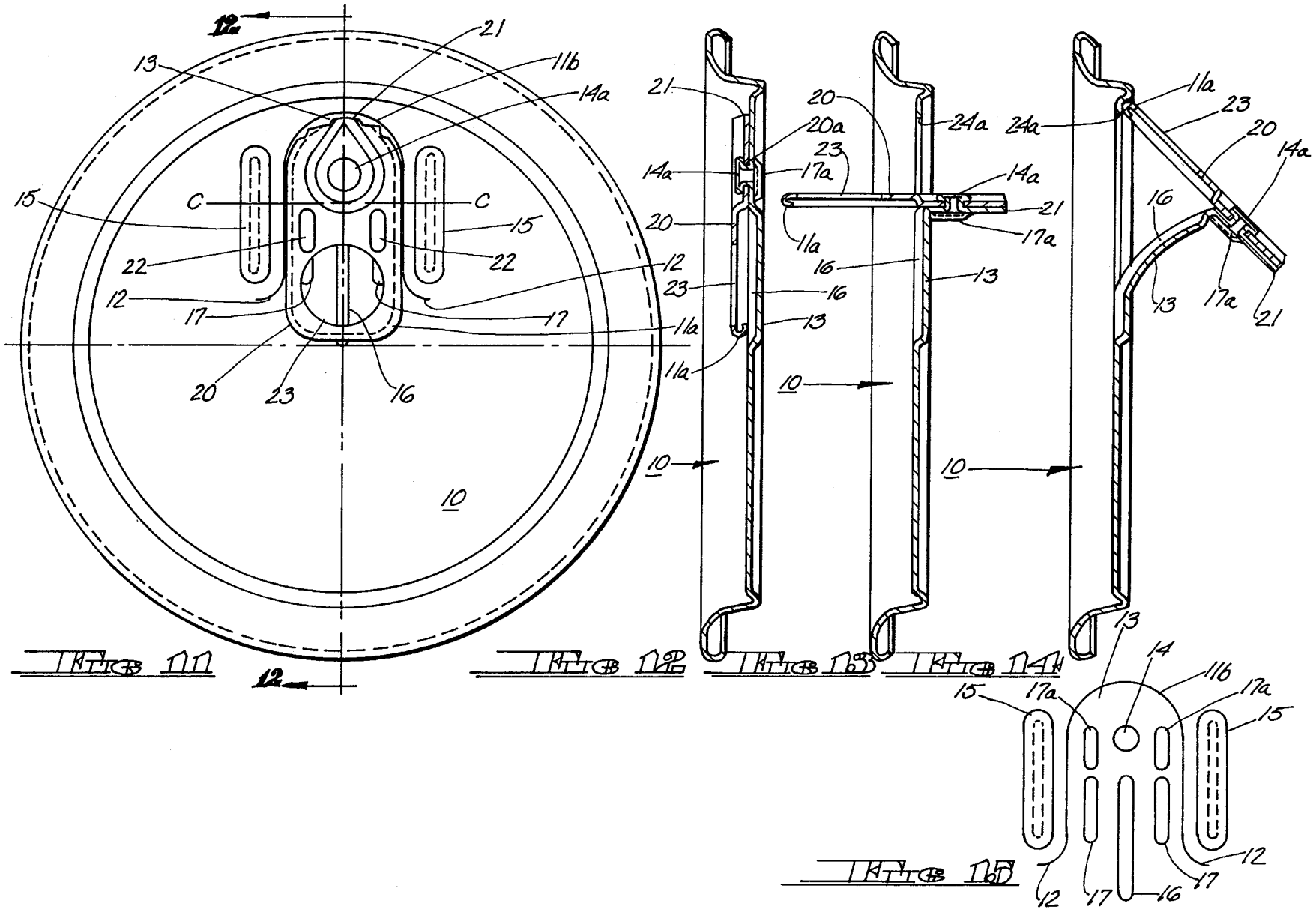

FIGS. 1 to 5 show the preferred embodiment. The can end is generally indicated at 10. There is provided a primary score in the can end indicated at 11. This score as best seen in FIG. 5 is generally U-shaped with the open end of the U toward the center of the can and with the ends of the U flared outwardly as at 12. The flares 12 limit the extent to which the tear strip 13 within the score 11 may be torn out.

An integral rivet is formed at 14 and a pair of beads are embossed, one on each side of the tear strip 13, as indicated at 15. These beads mask the sharp edges of the opening and also serve as stiffeners to stiffen that portion of the can end so that the tab and tear strip can be easily pushed downward into the can end as will be described hereinafter. A bead 16 is debossed axially of the can and aligned with the rivet 14. This bead provides some resistance to bending of the open tear strip so that the pull tab will snap under the opened edge of the can end as will be described hereinafter. The debossed beads 17, although not absolutely essential to the operation of this invention, may be provided to assist in the function of the bead 16.

The pull tab is indicated at 20 and it is secured to the can end by placing a hole **20*a* in the pull tab over the rivet 14 and then riveting the rivet 14 as indicated at 14*a*. The pull tab 20 has a penetrating nose 21 which is disposed at the center of the bottom of the U-shaped score 11. The pull tab is preferably provided with a pair of stiffening beads 22 and a hole 23. The hole 23 is preferably small enough that a finger cannot be inserted in it and its purpose is simply to make pouring through the opening easier and to avoid restriction of such flow. In this embodiment the pull tab is lanced as indicated at 24. It will be observed that this cut or lance is in a semicircular configuration around the rivet 14***a* to the rear thereof. It will also be noted that the pull tab 20 is very slightly narrower than the distance between the arms of the primary score 11. The pull tab as is well known will have a hemmed edge at 11*a* for stiffening purposes and for turning the sharp tab edges away from the finger of the consumer.

Referring now to FIGS. 2 to 4 inclusive, when the pull tab 20 is elevated to the vertical as seen in FIG. 3 the penetrating nose 21 ruptures the bottom of the U-shaped score 11 and it will be noted that the tear strip 13 bends on the line A—A (FIG. 1). The pull tab in the position of FIG. 3 is then pushed downwardly into the can or to the right as seen in the Figure. The tear strip 13 is torn out to the flares 12 in the score 11 whereupon the end of the pull tab may be snapped under the edge of the opening as seen in FIG. 4. The stiffening provided by the bead 16 makes it possible for the pull tab 20 to be snapped under the edge 24 of the opening formed by removal of the tear strip.

At this point it will be noted that while in the Wells patent described above the tear strip is bent straight down and in order for the pull tab to be fixed in position when the can is opened, the lateral projections must snap under the edges of the opening. According to the present invention the bead 16 provides sufficient stiffening so that the tear strip 13 is bent gradually and provides sufficient resilience that the end of the pull tab can snap under the forward edge of the opening as clearly seen in FIGS. 4, 9 and 14. Since the tab in its entirety snaps under the open edge of the can, it is extremely difficult if not impossible for a consumer to reach in and remove the tab.

Obviously the width of the score 11 must be sufficient to permit the tab to pass through it without interference. Thus, for example, if the tab is 0.5 inch wide the width between the arms of the U would be 0.52 inch. This will provide sufficient clearance for the tab to pass through the opening so that it can be snapped into position as indicated in FIG. 4.

The embodiment of FIGS. 6 to 10 inclusive differs in one particular respect from the embodiment of FIGS. 1 to 5. The embodiment of FIGS. 6 to 10 inclusive does not have the lanced cut 24 but instead has an auxiliary score indicated at 26. This score which is sometimes referred to as a "moustache" score, has a central semicircular portion 25 about the axis of the rivet 14 as a center and disposed behind the rivet and the portion 25 merges into reversely curved semicircular portions 26 of smaller radius. By virtue of this arrangement, the pull tab bends the tear strip 13 on the line B—B which is substantially tangent to the smaller radius curved portions 26 of the moustache score. Since the auxiliary score 26-25-26 fractures first, the area between the score and the rivet becomes a loose flap of metal and this flap goes with the tab until the primary score line 11 is fractured by the penetrating nose 21. In other words, the rivet 14 remains in alignment with the tab 20 in FIG. 8 rather than in alignment with the can end as seen in FIG. 3.

Other parts in FIGS. 6 to 10 inclusive have been given the same reference numerals as in FIGS. 1 to 5 and only the different portions have been renumbered.

In the embodiment of FIGS. 11 to 15 inclusive the forward end of the tear strip 13 is semi-circular about the center of the rivet 14 and with the radius half the width of the tear strip. In this embodiment additional debossed beads 17*a* are provided one on each side of the rivet 14 and extending toward the center of the can and in this embodiment when the pull tab is raised in FIG. 13 the bend line is indicated at C—C substantially tangent to the rearward ends of the beads 17*a*.

In all other respects this embodiment functions in the same way as those previously described.

It should be understood that the embodiment of FIGS. 1 to 5 is the preferred embodiment and that the embodiment of FIGS. 6 to 10 is preferred over the embodiments of FIGS. 11 to 15. Nevertheless all three embodiments perform in substantially the same way and in all of them the pull tab is snapped under the edge of the opening formed by removal of the tear strip and is then disposed entirely within the can, and substantially out of the reach of the user, and the objects of the invention are achieved in all three embodiments.

It will be understood that minor modifications may be made without departing from the spirit of the invention and therefore no limitation is intended other than those specifically set forth in the claims and no such limitation should be implied.

The embodiments of the invention in which an exclusive property or privilege is claimed are defined as follows:

1. In an easy-open can end having a primary score defining a tear tab, an integral rivet in said score, and a pull tab secured to said can end by means of said rivet, said primary score being generally U-shaped with the open end of the U toward the center of the can end, the ends of the U being flared outwardly, and the parallel arms of the U being spaced very slightly further apart than the width of said pull tab, said tab having a penetrating nose disposed over the bottom center of the U; stiffening beads embossed in said can end, one on each side of said pull tab and parallel thereto, and extending slightly in front of said rivet, and a substantial amount behind said rivet, and an axial bead debossed in said can end extending behind said rivet to a point beyond the end of said pull tab, whereby when said pull tab is raised to a vertical position, said penetrating nose ruptures said primary score, whereupon downward pressure on said vertical pull tab causes the remainder of said primary score to be ruptured and the tear tab to be bent downwardly below the can end, and said tab may then be bent forwardly and snapped under the opened edge of said can end, the entire tear strip and pull tab being thus disposed below said can end.

2. The structure of claim 1, wherein said pull tab is lanced in a generally semicircular configuration around the rear of said rivet, whereby, when said pull tab is raised to the vertical position, said tear strip bends in front of said rivet.

3. The structure of claim 2, wherein a pair of relatively short debossed beads is provided in said can end, one on each side of said axial bead, to provide additional stiffening for said tear strip.

* * * * *